US009017915B2

(12) United States Patent
Ganapathiappan et al.

(10) Patent No.: US 9,017,915 B2
(45) Date of Patent: Apr. 28, 2015

(54) ELECTROPHOTOGRAPHIC INK

(75) Inventors: Sivapackia Ganapathiappan, Los Altos, CA (US); Hou T. Ng, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1039 days.

(21) Appl. No.: 12/831,896

(22) Filed: Jul. 7, 2010

(65) Prior Publication Data

US 2012/0009516 A1 Jan. 12, 2012

(51) Int. Cl.

| | |
|---|---|
| ***G03G 13/10*** | (2006.01) |
| ***G03G 15/10*** | (2006.01) |
| ***G03G 9/12*** | (2006.01) |
| ***G03G 9/125*** | (2006.01) |
| ***G03G 9/13*** | (2006.01) |
| ***G03G 9/135*** | (2006.01) |

(52) U.S. Cl.
CPC ..... *G03G 15/10* (2013.01); *G03G 9/122* (2013.01); *G03G 9/125* (2013.01); *G03G 9/13* (2013.01); *G03G 9/131* (2013.01); *G03G 9/135* (2013.01); *G03G 9/1355* (2013.01)

(58) Field of Classification Search
USPC ..... 430/112–116, 117.1, 137.19
See application file for complete search history.

(56) References Cited

U.S. PATENT DOCUMENTS

| | | | | |
|---|---|---|---|---|
| 4,816,370 | A | 3/1989 | Croucher et al. | |
| 4,830,945 | A | 5/1989 | Wong et al. | |
| 5,130,221 | A * | 7/1992 | El-Sayed et al. | 430/114 |
| 6,053,438 | A | 4/2000 | Romano et al. | |
| 6,113,810 | A | 9/2000 | Hou et al. | |
| 6,476,096 | B1 * | 11/2002 | Molloy et al. | 523/160 |
| 6,495,618 | B1 | 12/2002 | Ma | |
| 6,905,807 | B2 | 6/2005 | Morrison et al. | |
| 7,683,120 | B2 | 3/2010 | Thetford et al. | |
| 2004/0241567 | A1 * | 12/2004 | Teraoka et al. | 430/115 |
| 2005/0223939 | A1 | 10/2005 | Uozumi et al. | |
| 2009/0297977 | A1 * | 12/2009 | Sasaki et al. | 430/113 |

FOREIGN PATENT DOCUMENTS

EP 1956438 A1 * 8/2008

OTHER PUBLICATIONS http://www.convertunits.com/from/mPa-s/to/centipoise, 2012, ConvertUnits.com.*
EP 1956438 A1, 08-02008, Yodo et. al.*
Bruce MacEvoy, http://www.handprint.com/HP/WCL/waterc.html, Aug. 1, 2005, www.handprint.com.*
Lubrizol Corporation, http://www.lubrizol.com/WorkArea/DownloadAsset.aspx?id=38830, Jun. 4, 2007, Lubrizol Advanced Materials, Inc.*

* cited by examiner

*Primary Examiner* — Peter Vajda
*Assistant Examiner* — Rashid Alam
(74) *Attorney, Agent, or Firm* — Thorpe, North & Western L.L.P.

(57) ABSTRACT

The present disclosure provides inks, systems, and methods directed towards dispersed pigments. In one embodiment, an electrophotographic ink can comprise an aliphatic solvent and a pigment having a surface comprising carbonyl groups stabilized by an amine dispersant having the structure: $R_1R_2N[(CH_2)_nNR_5]_m(CH_2)_pNR_3R_4$, where $R_1$, $R_3$, $R_4$, and $R_5$ are independently selected from the group of H; $COR_6$; $COOR_6$; $CONHR_6$; linear or branched, substituted or unsubstituted, alkyl; linear or branched, substituted or unsubstituted, aryl; and combinations thereof; $R_2$ is an aliphatic polymer chain; $R_6$ is selected from the group of H; linear or branched, substituted or unsubstituted, alkyl; linear or branched, substituted or unsubstituted, aryl; and combinations thereof; m is from 0 to 200; n is from 1 to 20; and p is from 1 to 20; where the electrophotographic ink has a low field conductivity of less than 200 pS/cm and a viscosity from about 0.5 to about 40 cps.

15 Claims, No Drawings

ELECTROPHOTOGRAPHIC INK

BACKGROUND

Digital printing involves technologies in which a printed image is created directly from digital data, for example using electronic layout and/or desktop publishing programs. Known methods of digital printing include full-color ink-jet, electrophotographic printing, laser photo printing, and thermal transfer printing methods.

Electrophotographic printing techniques involve the formation of a latent image on a photoconductor surface mounted on an imaging plate. The photoconductor is first sensitized to light, usually by charging with a corona discharge, and then exposed to light projected through a positive film of the document to be reproduced, resulting in dissipation of the charge in the areas exposed to light. The latent image is subsequently developed into a full image by the attraction of oppositely charged toner particles to the charge remaining on the unexposed areas. The developed image is transferred from the photoconductor to a rubber offset blanket, from which it is transferred to a substrate, such as paper, plastic or other suitable material, by heat or pressure or a combination of both to produce the printed final image.

The latent image is developed using either a dry toner (a colorant mixed with a powder carrier) or a liquid ink (a suspension of a colorant in a liquid carrier). The toner or ink generally adheres to the substrate surface with little penetration into the substrate. The quality of the final image is largely related to the size of the particles, with higher resolution provided by smaller particles.

Dry toners used in solid electrophotography are fine powders with a relatively narrow particle size distribution that are expelled from fine apertures in an application device. A typical dry toner is predominantly composed of a heat-sensitive polymer (e.g., acrylic, styrene) and a pigment such as carbon black with a solid carrier, typically resin coated iron or steel powders. Variations in particle shape and charge-to-mass ratio as well as dust particles found in the dry ink may cause technical difficulties during the printing process. Larger or irregularly shaped particles can cause blockage while dust particles that are too small to hold a sufficient charge to be controllable adhere to the print head surface.

Liquid inks used in liquid electrophotography are generally comprised of pigment- or dye-based thermoplastic resin particles suspended in a non-conducting liquid carrier, generally a saturated hydrocarbon. Offset-preventing and release-facilitating oil, such as silicone oil, is often used to increase the efficiency of ink transfer from the imaging surface. The liquid ink is electrophotographically charged and brought into contact with the photoconductor surface to develop the latent image. When transferred to an offset blanket and heated, the particles melt and fuse to form a tacky polymer film. When the tacky polymer film comes in contact with a cooler surface, such as a paper substrate, the film hardens and adheres to the substrate and peels away from the blanket, laminating the paper. The ink is deposited onto the substrate essentially dry, and desired print finishing can be performed immediately. Since the ink is transferred essentially completely from the blanket to the substrate, a new layer in a different color can be created for every rotation of the press.

DETAILED DESCRIPTION

Before the present invention is disclosed and described, it is to be understood that this disclosure is not limited to the particular process steps and materials disclosed herein because such process steps and materials may vary somewhat. It is also to be understood that the terminology used herein is used for the purpose of describing particular embodiments only. The terms are not intended to be limiting because the scope of the present disclosure is intended to be limited only by the appended claims and equivalents thereof.

It is noted that, as used in this specification and the appended claims, the singular forms "a," "an," and "the" include plural referents unless the context clearly dictates otherwise.

As used herein, "solvent" refers to the fluid in which the pigment of the present disclosure can be dispersed to form a pigment dispersion. Such a solvent can be formulated into an electrophotographic ink vehicle appropriate for electrophotographic printing where the electrophotographic ink vehicle has a viscosity and conductivity for such printing and may include a mixture of a variety of different agents, including without limitation, surfactants, organic solvents and co-solvents, charge control agents, buffers, biocides, viscosity modifiers, sequestering agents, stabilizing agents, and anti-kogation agents. Though not part of the electrophotographic ink vehicle per se, in addition to the pigment, the liquid vehicle general includes a dispersant for the pigment and can further carry solid additives such as polymers, latexes, UV curable materials, plasticizers, salts, etc.

As used herein, "co-solvent" refers to any solvent, including organic solvents, present in the electrophotographic ink vehicle.

As used herein, "pigment" generally includes pigment colorants, magnetic particles, aluminas, silicas, and/or other ceramics, organo-metallics or other opaque particles, whether or not such particulates impart color. Thus, though the present description primarily exemplifies the use of pigment colorants, the term "pigment" can be used more generally to describe not only pigment colorants, but other pigments such as organometallics, ferrites, ceramics, etc. In one specific embodiment, however, the pigment is a pigment colorant.

As used herein, "substituted" means that a hydrogen atom of a compound or moiety is replaced by another atom such as a carbon atom or a heteroatom, which is part of a group referred to as a substituent. Substituents include, for example, alkyl, alkoxy, aryl, aryloxy, alkenyl, alkenoxy, alkynyl, alkynoxy, thioalkyl, thioalkenyl, thioalkynyl, and thioaryl.

As used herein, "heteroatom" refers to nitrogen, oxygen, halogens, phosphorus, or sulfur.

As used herein, "alkyl" refers to a branched, unbranched, or cyclic saturated hydrocarbon group, which typically, although not necessarily, contains from 1 to about 50 carbon atoms, or 1 to about 40 carbon atoms, or 1 to about 30 carbon atoms, for example. Alkyls include, but are not limited to, methyl, ethyl, n-propyl, isopropyl, n-butyl, isobutyl, t-butyl, octyl, and decyl, for example, as well as cycloalkyl groups such as cyclopentyl, and cyclohexyl, for example. The term "lower alkyl" refers to an alkyl group having from 1 to 6 carbon atoms. The term "higher alkyl" refers to an alkyl group having more than 6 carbon atoms, for example, 7 to about 50 carbon atoms, or 7 to about 40 carbon atoms, or 7 to about 30 carbon atoms or more. As used herein, "substituted alkyl" refers to an alkyl substituted with one or more substituent groups. The term "heteroalkyl" refers to an alkyl in which at least one carbon atom is replaced with a heteroatom. If not otherwise indicated, the term "alkyl" includes unsubstituted alkyl, substituted alkyl, lower alkyl, and heteroalkyl.

As used herein, "aryl" refers to a group containing a single aromatic ring or multiple aromatic rings that are fused together, directly linked, or indirectly linked (such that the different aromatic rings are bound to a common group such as a methylene or ethylene moiety). Aryl groups described herein may contain, but are not limited to, from 5 to about 50 carbon atoms, or 5 to about 40 carbon atoms, or 5 to 30 carbon atoms or more. Aryl groups include, for example, phenyl, naphthyl, anthryl, phenanthryl, biphenyl, diphenylether, diphenylamine, and benzophenone. The term "substituted aryl" refers to an aryl group comprising one or more substituent groups. The term "heteroaryl" refers to an aryl group in which at least one carbon atom is replaced with a heteroatom. If not otherwise indicated, the term "aryl" includes unsubstituted aryl, substituted aryl, and heteroaryl.

As used herein, the term "aliphatic polymer chain" refers to hydrophobic chains, typically, but not limited to having a number average molecular weight less than 100,000, e.g., from 100 to 10,000 or from 300 to 5,000, etc.

As used herein, the term "about" is used to provide flexibility to a numerical range endpoint by providing that a given value may be "a little above" or "a little below" the endpoint. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 wt % to about 5 wt %" should be interpreted to include not only the explicitly recited values of about 1 wt % to about 5 wt %, but also include individual values and sub-ranges within the indicated range. Thus, included in this numerical range are individual values such as 2, 3.5, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

It has been recognized that a pigment can be stably dispersed in an electrophotographic ink through the use of amine dispersants. In other words, the dispersed pigment disclosed herein can be used in electrophotographic inks for electrophotographic printing. These types of compositions typically have significantly different characteristics than traditional aqueous based ink-jet inks. As such, the present inks can provide an acceptable viscosities and conductivity for electrophotographic printing in addition to maintaining a dispersed pigment over a significant period of time.

In accordance with this, the present disclosure is drawn to electrophotographic ink compositions, systems, and methods, where the electrophotographic ink generally comprises an aliphatic solvent and a pigment dispersed therein. It is noted that when discussing the present compositions, systems, and associated methods, each of these discussions can be considered applicable to each of these embodiments, whether or not they are explicitly discussed in the context of that embodiment. Thus, for example, in discussing an aliphatic solvent for use in an electrophotographic ink, such a solvent can also be used for a method of dispersing a pigment in the solvent or a system for printing an ink having such a solvent, and vice versa.

An electrophotographic ink can comprise an aliphatic solvent and a pigment having a surface comprising carbonyl groups stabilized by an amine dispersant having the structure: $R_1R_2N[(CH_2)_nNR_5]_m(CH_2)_pNR_3R_4$ where $R_1$, $R_3$, $R_4$, and $R_5$ are independently selected from the group of H; $COR_6$; $COOR_6$; $CONHR_6$; linear or branched, substituted or unsubstituted, alkyl; linear or branched, substituted or unsubstituted, aryl; and combinations thereof; $R_2$ is an aliphatic polymer chain; $R_6$ is selected from the group of H; linear or branched, substituted or unsubstituted, alkyl; linear or branched, substituted or unsubstituted, aryl; and combinations thereof; m is from 0 to 200; n is from 1 to 20; and p is from 1 to 20. Additionally, the electrophotographic ink can have a low field conductivity of less than 200 pS/cm and a viscosity from about 0.5 to about 40 cps.

A method of dispersing a pigment in an electrophotographic ink can comprise combining an aliphatic solvent, a pigment, and an amine dispersant to form a mixture, the pigment having a surface comprising carbonyl groups and shearing the mixture sufficient to disperse the pigment. Additionally, the pigment can be dispersed by interaction of the amine dispersant with the carbonyl groups on the surface of the pigment.

A system for printing an electrophotographic ink can comprise an electrophotographic printer and an electrophotographic ink. The electrophotographic ink can be any electrophotographic ink described herein. The system can further comprise a recording medium for receiving the electrophotographic ink when printed thereon using the electrophotographic printer.

Generally, the aliphatic solvent used herein can be any aliphatic solvent including substituted or unsubstituted, linear or branched, aliphatic compounds. Additionally, such solvents can include aryl substituents. In one embodiment, the aliphatic solvent can be substantially nonaqueous, e.g., containing less than 0.5% water. In another embodiment, the aliphatic solvent can be nonaqueous. The aliphatic solvent can comprise a member selected from the group of paraffins, isoparaffins, oils, alkanes having from about 6 to about 100 carbon atoms, and mixtures thereof.

In one embodiment, such inks can include at least one aliphatic hydrocarbon, such as a paraffin and/or isoparaffin. As such, the aliphatic solvent can comprise, or substantially comprise, or even consist essentially of isoparaffins, such as or equivalent to the ISOPAR® high-purity isoparaffinic solvents with narrow boiling ranges marketed by Exxon Mobil Corporation (Fairfax, Va., USA). Also suitable as an aliphatic solvent, or cosolvent, for implementing embodiments of the present invention are alkanes having from about 6 to about 14 carbon atoms such as solvents sold under the NORPAR® (NORPAR® 12, 13 and 15) tradename available from Exxon Mobil Corporation (Fairfax, Va., USA). Other hydrocarbons for use as an aliphatic solvent, or cosolvent, are sold under the AMSCO® (AMSCO® 460 and OMS) tradename available from American Mineral Spirits Company (New York, N.Y., USA), under the SOLTROL® tradename available from Chevron Phillips Chemical Company LLC (The Woodlands, Tex., USA) and under the SHELLSOL® tradename available from Shell Chemicals Limited (London, UK). Such an aliphatic solvent, or cosolvent, can have desirable properties such as low odor, lack of color, selective solvency, good oxidation stability, low electrical conductivity, low skin irritation, low surface tension, superior spreadability, narrow boiling point range, non-corrosive to metals, low freeze point, high electrical resistivity, high interfacial tension, low latent heat of vaporization and low photochemical reactivity.

The dispersant used herein generally can be an amine dispersant having the structure: $R_1R_2N[(CH_2)_nNR_5]_m(CH_2)_pNR_3R_4$ where $R_1$, $R_3$, $R_4$, and $R_5$ are independently selected from the group of H; $COR_6$; $COOR_6$; $CONHR_6$; linear or branched, substituted or unsubstituted, alkyl; linear or branched, substituted or unsubstituted, aryl; and combinations thereof; $R_2$ is an aliphatic polymer chain; $R_6$ is selected from the group of H; linear or branched, substituted or unsubstituted, alkyl; linear or branched, substituted or unsubstituted, aryl; and combinations thereof; m is from 0 to 200; n is from 1 to 20; and p is from 1 to 20. In one embodiment, $R_1$ and $R_3$ can be H and n can be from 1 to 3. In another embodiment, $R_2$ can be a polyisobutylene group or polyalkylene chain. In still another embodiment, $R_4$ can be linear or branched, substituted or unsubstituted, alkyl.

The dispersants described herein generally stabilize the pigment, allowing the pigment to be dispersed in the solvent for a significant period of time. The dispersant can stabilize the pigment by interacting with carbonyl groups on the surface of the pigment. In one embodiment, the surface of the pigment can have a carbonyl density from 10 to $1\times10^6$ carbonyl/$\mu^2$. In another embodiment, the surface of the pigment can have a carbonyl density from $1\times10^3$ to $1\times10^5$ carbonyl/$\mu^2$. The dispersant can be present in the electrophotographic ink from about 1 wt % to about 150 wt % of the pigment weight. In one embodiment, the dispersant can be present from about 5 wt % to about 30 wt % of the pigment weight. In another embodiment, the dispersant can be present from about 10 wt % to about 25 wt % of the pigment weight.

Generally, the electrophotographic inks described herein can have a viscosity ranging from about 0.5 to about 40 cps. In one embodiment, the present electrophotographic inks can have a viscosity from about 3 cps to about 10 cps. Additionally, generally, the electrophotographic inks can have a conductivity of less than about 200 pS/cm. In one embodiment, the electrophotographic inks can have a conductivity of less than about 100 pS/cm, or in another embodiment, even less than 85 pS/cm.

Generally, the pigments used herein can be any colored pigments and non-colored pigments. In one embodiment, the pigment can be selected from the group of black pigment, white pigment, yellow pigment, cyan pigment, magenta pigment, and mixtures thereof. In one embodiment, the pigment can include a magenta pigment and/or a yellow pigment. Additionally, the pigment can be encapsulated with a polymer selected from the group of acrylic polymer, urethane polymer, copolymers thereof, and mixtures thereof. The pigment can be present in the electrophotographic ink from about 0.2 wt % to about 15 wt % of the electrophotographic ink. In one embodiment, the pigment can be present from about 1 wt % to about 5 wt % of the electrophotographic ink.

If an acrylic polymer is used, it can be copolymerized from hydrophobic and/or hydrophilic monomers, including acidic monomers. Hydrophobic monomers can be present in the acrylic copolymer from about 70 wt % to about 100 wt % of the polymer weight. Such hydrophobic monomers can include, without limitation, styrene, p-methyl styrene, methyl methacrylate, hexyl acrylate, hexyl methacrylate, butyl acrylate, butyl methacrylate, ethyl acrylate, ethyl methacrylate, propyl acrylate, propyl methacrylate, octadecyl acrylate, octadecyl methacrylate, stearyl methacrylate, vinylbenzyl chloride, isobornyl acrylate, tetrahydrofurfuryl acrylate, 2-phenoxyethyl methacrylate, ethoxylated nonyl phenol methacrylate, isobornyl methacrylate, cyclohexyl methacrylate, t-butyl methacrylate, n-octyl methacrylate, lauryl methacrylate, trydecyl methacrylate, alkoxylated tetrahydrofurfuryl acrylate, isodecyl acrylate, isobornylmethacrylate, combinations thereof, derivatives thereof, and mixtures thereof.

Acidic monomers can be present in the acrylic polymer from about 0.1 wt % to about 30 wt % of the polymer weight. Such acidic monomers can include, without limitation, acrylic acid, methacrylic acid, ethacrylic acid, dimethylacrylic acid, maleic anhydride, maleic acid, vinylsulfonate, cyanoacrylic acid, vinylacetic acid, allylacetic acid, ethylidineacetic acid, propylidineacetic acid, crotonoic acid, fumaric acid, itaconic acid, sorbic acid, angelic acid, cinnamic acid, styrylacrylic acid, citraconic acid, glutaconic acid, aconitic acid, phenylacrylic acid, acryloxypropionic acid, aconitic acid, phenylacrylic acid, acryloxypropionic acid, vinylbenzoic acid, N-vinylsuccinamidic acid, mesaconic acid, methacroylalanine, acryloylhydroxyglycine, sulfoethyl methacrylic acid, sulfopropyl acrylic acid, styrene sulfonic acid, sulfoethylacrylic acid, 2-methacryloyloxymethane-1-sulfonic acid, 3-methacryoyloxypropane-1-sulfonic acid, 3-(vinyloxy)propane-1-sulfonic acid, ethylenesulfonic acid, vinyl sulfuric acid, 4-vinylphenyl sulfuric acid, ethylene phosphonic acid, vinyl phosphoric acid, vinyl benzoic acid, 2-acrylamido-2-methyl-1-propanesulfonic acid, combinations thereof, derivatives thereof, and mixtures thereof.

Additionally, the acrylic polymers can include reactive surfactants such as functionalized ethylene glycol acrylates, including the SIPOMER® series of surfactants from Rhodia. Other non-limiting examples of reactive surfactants include HITENOL™ (polyoxyethylene alkylphenyl ether ammonium sulfate) and NOIGEN™ (polyoxyethylene alkylphenyl ether) reactive surfactants commercially available from Dai-Ichi Kogyo Seiyaku Co., Ltd. of Japan; TREM® (sulfosuccinates) commercially available from Henkel; and the MAXEMUL® (anionic phosphate ester) reactive surfactants commercially available from Uniqema of the Netherlands. Suitable grades of some of the materials listed above may include HITENOL BC-20, NOIGEN RN-30, TREM LT-40, and MAXEMUL 6106 and 6112.

If a polyurethane polymer is used, the polymer can comprise copolymerized monomers including a polyol and a diisocyante. As such, generally, the polyurethane includes a diisocyante portion, referred to as the hard segment, and a diol, referred to as the soft segment. Additionally, the polyurethane can comprise an acid polyol. In one embodiment, the polyurethane binder can include chain extenders. A chain extender is any compound capable of polymerizing with the diisocyanate such that the chain extender resides in the hard segment of the polyurethane. In one embodiment, the chain extender can be any compound having a molecular weight of less than 500 $M_w$ that resides in the hard segment that is not a diisocyanate. The molecular weights described herein refer to weight average molecule weights unless otherwise stated.

Generally, the polyol can be any type of polyfunctional alcohol including, for example, diols and triols. In one embodiment, the polyol can be selected from the group of polycaprolactone diol; ethylene glycol; polyethylene glycol; propylene glycol; polypropylene glycol; butylene glycol; polybutylene glycol; tetramethylene glycol; polytetramethylene glycol; poly(ethylene oxide) polymers; poly(propylene oxide) polymers; poly(tetramethylene oxide) polymers; copolymers thereof having terminal hydroxyl groups derived from polyhydric compounds including diols and triols; combinations thereof, and mixtures thereof.

The diisocyanates, described herein, can be selected from the group of methylene diphenyl diisocyanate, hexamethylene diisocyanate, p-tetramethyl xylene diisocyanate, m-tetramethyl xylene diisocyanate, bitolylene diisocyanate, toluene diisocyanate, methylene-bis(4-cyclohexyl)diisocyanate, p-phenylene diisocyanate, isophorone diisocyanate, 1,4-diisocyanatobutane, 1,5-naphthalene diisocyanate, 1,6-diisocyanatohexane, 1,12-diisocyanatododecane, 1,5-diisocyanato-2-methylpentane, 1,8-diisocyanatooctane, and mixtures thereof.

A method of dispersing a pigment in an aliphatic solvent, including those used in electrophotographic inks, can comprise combining the aliphatic solvent, the pigment, and the amine dispersant to form a mixture and shearing the mixture sufficient to disperse the pigment. In one embodiment, the shearing can be by ultrasonicating, paint shaking, microfluidizing, milling, or a combination thereof. Additionally, combining the aliphatic solvent, the pigment, and the amine dispersant can be performed sequentially in any order. In one embodiment, combining the aliphatic solvent, the pigment, and the amine dispersant can be performed simultaneously.

The present compositions, methods, and systems can provide a pigment dispersion used in electrophotographic inks where the pigment dispersion is stable for a significant period of time. In one embodiment, the pigment can remain dispersed in the electrophotographic ink for at least 2 weeks without any agitation. In another embodiment, the pigment can remain dispersed in the electrophotographic ink for at least 6 weeks without any agitation.

The electrophotographic ink vehicle can also comprise a surfactant. In one embodiment, the surfactant can be stearic acid, dioctylsulfosuccinate, dioctylbenzenesulfonic acid and sodium dodecylsulfate. In another embodiment, the surfactant can be a nonionic surfactant. Suitable surfactants that can be used include alkyl polyethylene oxides, alkyl phenyl polyethylene oxides, polyethylene oxide block copolymers, acetylenic polyethylene oxides, polyethylene oxide (di)esters, polyethylene oxide amines, protonated polyethylene oxide amines, protonated polyethylene oxide amides, dimethicone copolyols, substituted amine oxides, and the like. The amount of surfactant added to the electrophotographic inks can range from 0.01 wt % to 10 wt %.

The electrophotographic ink compositions of the present disclosure can also be suitable for use on many types of substrates of recording media, including but not limited to vinyl media, cellulose-based paper media, various cloth materials, polymeric materials (non-limitative examples of which include polyester white film or polyester transparent film), photopaper (non-limiting examples of which include polyethylene or polypropylene extruded on one or both sides of paper), metals, and/or mixtures or composites thereof. A non-limiting example of a suitable metal material is a metal in foil form made from, for example, at least one of aluminum, silver, tin, copper, ceramics, alloys thereof, and/or mixtures thereof. In one embodiment, the recording medium can include paper.

The present electrophotographic ink vehicles can include one or more co-solvents present in total at from 0.1 wt % to 30 wt %, or more, depending on the jetting architecture, though amounts outside of this range can also be used. In addition to the pigment and aliphatic solvent, the balance of the formulation can include other vehicle components known in the art, such as biocides, viscosity modifiers, materials for pH adjustment, sequestering agents, preservatives, and the like. The jetting architecture that can be used with the inks of the present invention includes thermal and piezoelectric print heads for electrophotographic printing applications.

Classes of co-solvents that can be used can include organic co-solvents including aliphatic alcohols, aromatic alcohols, diols, glycol ethers, polyglycol ethers, caprolactams, formamides, acetamides, and long chain alcohols. Examples of such compounds include primary aliphatic alcohols, secondary aliphatic alcohols, 1,2-alcohols, 1,3-alcohols, 1,5-alcohols, ethylene glycol alkyl ethers, propylene glycol alkyl ethers, higher homologs ($C_6$-$C_{12}$) of polyethylene glycol alkyl ethers, N-alkyl caprolactams, unsubstituted caprolactams, both substituted and unsubstituted formamides, both substituted and unsubstituted acetamides, and the like.

Consistent with the formulation of this disclosure, various other additives may be employed to optimize the properties of the ink composition for specific applications. Sequestering agents, such as EDTA (ethylene diamine tetra acetic acid), may be included to eliminate the deleterious effects of heavy metal impurities, and buffer solutions may be used to control the pH of the ink. From 0 wt % to 2 wt %, for example, can be used. Viscosity modifiers and buffers may also be present, as well as other additives known to those skilled in the art to modify properties of the ink as desired. Such additives can be present at from 0 wt % to 20 wt %.

EXAMPLES

The following examples illustrate a number of embodiments of the present compositions, systems, and methods that are presently known. However, it is to be understood that the following are only exemplary or illustrative of the application of the principles of the present compositions, systems, and methods. Numerous modifications and alternative compositions, methods, and systems may be devised by those skilled in the art without departing from the spirit and scope of the present systems and methods. The appended claims are intended to cover such modifications and arrangements. Thus, while the present compositions, systems, and methods have been described above with particularity, the following examples provide further detail in connection with what are presently deemed to be the acceptable embodiments.

Example 1

Magenta Pigment Dispersion

A magenta pigment dispersion was manufactured as follow: 1 g of a magenta primary pigment (PR 122) was added to 0.6 g of an amine dispersant (Lubrizol 2155) in 18.4 g of an isoparaffin solvent (ISOPAR L®). This mixture was ultrasonicated for 10 min at 90% amplitude using a Branson 450 digital sonifier. The resulting dispersion was collected and monitored for stability for the visual settling of particles. The dispersion was stable over a period of at least two weeks.

Example 2

Magenta Pigment Dispersion

A magenta pigment dispersion was formed by the steps of Example 1, except that Lubrizol 2155 was replaced with a different amine dispersant (OS# 45479AB also from Lubrizol). The dispersion obtained was stable over a period of at least six weeks.

Example 3

Comparative Magenta Pigment Dispersions

Example 1 was repeated with non-amine containing dispersants, SOLSPERSE® 8000 and 19000. The dispersions obtained settled within 24 hours.

Example 4

Yellow Pigment Dispersion

A yellow pigment dispersion was manufactured as follow: 1 g of a yellow pigment was added to 0.6 g of an amine dispersant (OS# 45479AB by Lubrizol) in 18.4 g of an isoparaffin solvent (ISOPAR L®). This mixture was ultrasonicated for 10 min at 90% amplitude using a Branson 450 digital sonifier. The resulting dispersion was collected and monitored for stability for the visual settling of particles. The dispersion was stable over a period of at least two weeks.

Example 5

Comparative Yellow Pigment Dispersion

Example 4 was repeated with a non-amine containing dispersant, SOLSPERSE® 9000. The dispersion obtained settled within 24 hours.

While the disclosure has been described with reference to certain preferred embodiments, those skilled in the art will appreciate that various modifications, changes, omissions, and substitutions can be made without departing from the spirit of the disclosure. It is intended, therefore, that the invention be limited only by the scope of the following claims.

What is claimed is:

1. An electrophotographic ink, comprising:

an aliphatic solvent;

a pigment having a surface comprising carbonyl groups; and an amine dispersant which stabilizes the surface of the pigment and has the structure $R_1R_2N[(CH_2)_nNR_5]_m(CH_2)_pNR_3R_4$, where $R_1$, $R_3$, $R_4$, and $R_5$ are independently selected from the group consisting of H; $COR_6$; $COOR_6$; $CONHR_6$; linear or branched, substituted or unsubstituted, alkyl; linear or branched, substituted or unsubstituted, aryl; and combinations thereof; $R_2$ is an aliphatic polymer chain; $R_6$ is selected from the group consisting of H; linear or branched, substituted or unsubstituted, alkyl; linear or branched, substituted or unsubstituted, aryl; and combinations thereof; m is from 0 to 200; n is from 1 to 20; and p is from 1to 20, wherein the electrophotographic ink has a low field conductivity of less than 200 pS/cm and a viscosity from about 0.5 to about 40 cps; and wherein the pigment is encapsulated with a polymer selected from the group consisting of acrylic polymer, urethane polymer, copolymers thereof, and mixtures thereof.

2. The electrophotographic ink of claim 1, wherein the ink is nonagueous.

3. The electrophotographic ink of claim 1, wherein the aliphatic solvent comprises a member selected from the group consisting of paraffins, isoparaffins, oils, alkanes having from about 6 to about 100 carbon atoms, and mixtures thereof.

4. The electrophotographic ink of claim 1, wherein the surface of the pigment has a carbonyl density from 10 to $1\times10^6$ carbonyl/$\mu^2$.

5. The electrophotographic ink of claim 1, wherein $R_1$ and $R_3$ are H and n is from 1 to 3.

6. The electrophotographic ink of claim 1, wherein $R_2$ is polyisobutylene.

7. The electrophotographic ink of claim 1, wherein $R_4$ is linear or branched, substituted or unsubstituted, alkyl.

8. The electrophotographic ink of claim 1, wherein the viscosity is from about 3 cps to about 10 cps.

9. The electrophotographic ink of claim 1, wherein the pigment includes a magenta pigment or a yellow pigment,

10. The electrophotographic ink of claim 1, wherein the acrylic polymer comprises a reactive surfactant comprising functionalized ethylene glycol acrylate; and the urethane polymer comprises a polyol and a diisocyante.

11. The electrophotographic ink of claim 1, wherein the pigment is present in the electrophotographic ink from about 0.2 wt % to about 15 wt % of the electrophotographic ink.

12. The electrophotographic ink of claim 1, wherein the dispersant is present in the electrophotographic ink from about 1 wt % to about 150 wt % of the pigment weight.

13. A system for printing an electrophotographic ink, comprising an electrophotographic printer;

the electrophotographic ink comprising:

an aliphatic solvent;

a pigment having a surface comprising carbonyl groups; and an amine dispersant which stabilizes the surface of the pigment and has the structure $R_1R_2N[(CH_2)_nNR_5]_m(CH_2)_pNR_3R_4$, where $R_1$, $R_3$, $R_4$, and $R_5$ are independently selected from the group consisting of H; $COR_6$; $COOR_6$; $CONHR_6$; linear or branched, substituted or unsubstituted, alkyl; linear or branched, substituted or unsubstituted, aryl; and combinations thereof; $R_2$ is an aliphatic polymer chain; $R_6$ is selected from the group consisting of H; linear or branched, substituted or unsubstituted, alkyl; linear or branched, substituted or unsubstituted, aryl; and combinations thereof; m is from 0 to 200; n is from 1 to 20; and p is from 1 to 20;

wherein the electrophotographic ink has a low field conductivity of less than 200 pS/cm and a viscosity from about 0.5 to about 40 cps; and wherein the pigment is encapsulated with a polymer selected from the group consisting of acrylic polymer, urethane polymer, copolymers thereof, and mixtures thereof.

14. The system of claim 13, further comprising a recording medium.

15. The system of claim 13, wherein n is from 1 to 3, $R_1$ and $R_3$ are H, $R_2$ is polyisobutylene, and $R_4$ is linear or branched, substituted or unsubstituted, alkyl.

* * * * *